US009650735B2

(12) United States Patent
Doh et al.

(10) Patent No.: US 9,650,735 B2
(45) Date of Patent: May 16, 2017

(54) LAUNDRY MACHINE AND METHOD FOR CONTROLLING THE SAME

(71) Applicant: LG ELECTRONICS INC., Seoul (KR)

(72) Inventors: Youngjin Doh, Changwon-si (KR); Jihong Lee, Changwon-si (KR); Hyunchul Choi, Changwon-si (KR); Kyuhwan Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 345 days.

(21) Appl. No.: 13/856,603

(22) Filed: Apr. 4, 2013

(65) Prior Publication Data

US 2013/0276327 A1 Oct. 24, 2013

(30) Foreign Application Priority Data

Apr. 6, 2012 (KR) ..... 10-2012-0036083
Apr. 10, 2012 (KR) ..... 10-2012-0037067

(51) Int. Cl.
*D06F 29/00* (2006.01)
*D06F 58/22* (2006.01)
(Continued)

(52) U.S. Cl.
CPC ..... *D06F 29/005* (2013.01); *D06F 25/00* (2013.01); *D06F 58/22* (2013.01); *D06F 58/28* (2013.01); *D06F 58/24* (2013.01); *D06F 2212/00* (2013.01)

(58) Field of Classification Search
CPC ..... D06F 25/00; D06F 39/088; D06F 39/10; D06F 58/22; D06F 37/22; D06F 29/005; D06F 58/24; D06F 58/28; D06F 2212/00
See application file for complete search history.

(56) References Cited

U.S. PATENT DOCUMENTS 3,563,474 A * 2/1971 Robinson ..... B05B 1/02 134/172
2004/0221474 A1 11/2004 Slutsky et al.
2006/0075577 A1 4/2006 Jeong et al.

FOREIGN PATENT DOCUMENTS

CN 1702225 A 11/2005
CN 1766211 A 5/2006
(Continued)

OTHER PUBLICATIONS

Korean Notice of Allowance dated Jan. 29, 2015 issued in Application No. 10-2012-0036083.
(Continued)

*Primary Examiner* — Jiping Lu
(74) *Attorney, Agent, or Firm* — KED & Associates, LLP

(57) ABSTRACT

A method for controlling a laundry machine is provided, including an air supply cycle in which heated or unheated air is supplied to items received in a holding space. The air supply cycle may include initiating operation of a fan for circulating the air in the holding space, the fan being provided in a duct that forms a flow passage for circulating the air in the holding space, and spraying cleaning water onto a filter for removing foreign matter from the filter, the filter being positioned under the fan for removing foreign matter from air being introduced into the duct from the holding space. Spraying cleaning water onto the filter for removing foreign matter from the filter is not performed at the same time as initiating operation of the fan.

6 Claims, 14 Drawing Sheets

(51) Int. Cl.

| | |
|---|---|
| ***D06F 25/00*** | (2006.01) |
| ***D06F 58/28*** | (2006.01) |
| *D06F 58/24* | (2006.01) |

(56) References Cited

FOREIGN PATENT DOCUMENTS

| | | | | |
|---|---|---|---|---|
| EP | 0648885 | A1 | | 4/1995 |
| EP | 2 386 679 | A1 | | 11/2011 |
| JP | H07-275591 | A | | 10/1995 |
| JP | 10132350 | A | * | 5/1998 |
| JP | 2004-261324 | A | | 9/2004 |
| JP | 2007-037890 | A | | 2/2007 |
| JP | 2009-142351 | A | | 7/2009 |
| KR | 2003009961 | A | * | 2/2003 |
| KR | 10-2006-0065266 | A | | 6/2006 |
| KR | 10-2010-0094687 | A | | 8/2010 |
| KR | 10-2010-0129151 | A | | 12/2010 |
| KR | 10-2010-0129242 | A | | 12/2010 |
| KR | 10-2011-0125390 | A | | 11/2011 |
| WO | WO 2005/017249 | A1 | | 2/2005 |
| WO | WO 2009/015919 | A1 | | 2/2009 |
| WO | WO 2010/137910 | A2 | | 12/2010 |
| WO | WO 2012/138136 | A2 | | 10/2012 |

OTHER PUBLICATIONS

Australian Patent Examination Report dated Mar. 13, 2015 issued in Application No. 2013244151.

International Search Report dated Sep. 30, 2013 for corresponding Application Serial No. PCT/KR2013/002799.

European Search Report issued in Application No. 13772143.7 dated Oct. 19, 2015.

Chinese Office Action issued in Application No. 201410150473.X dated Nov. 2, 2015.

Chinese Office Action issued in Application No. 201380002993.X dated Aug. 11, 2015.

* cited by examiner

LAUNDRY MACHINE AND METHOD FOR CONTROLLING THE SAME

CROSS-REFERENCE TO RELATED APPLICATION(S)

This application claims priority under 35 U.S.C. §119 to Korean Application Nos. 10-2012-0036083 filed on Apr. 6, 2012 and 10-2012-0037067 filed on Apr. 10, 2012, whose entire disclosures are hereby incorporated by reference.

BACKGROUND

1. Field

This relates to a laundry machine and a method for controlling the same.

2. Background

A laundry machine may remove dirt from laundry items using a softening action, a friction force of water flow and an impact to the laundry items caused by rotation of a pulsator or a drum. A fully automatic laundry machine may perform a continuous series of cycles including washing, rinsing, and spinning without user manipulation during a washing operation.

BRIEF DESCRIPTION OF THE DRAWINGS

The embodiments will be described in detail with reference to the following drawings in which like reference numerals refer to like elements wherein:

FIGS. 10A, 10B, 10C, 11, 12 and 13 each illustrate structures of a filter cleaning device, in accordance with embodiments as broadly described herein.

DETAILED DESCRIPTION

Reference will now be made in detail to specific embodiments, examples of which are illustrated in the accompanying drawings. In absence of any specific definition, terms herein may be afforded the same general meaning as that which is understood by one skilled in this field of art. If a term used herein conflicts with the generally understood meaning of the term, the meaning of the term used in the specification may prevail. Various configurations or control methods of a device as broadly described herein are provided only for describing exemplary embodiments, and not should not be construed as limiting. Wherever possible, the same reference numbers will be used throughout the drawings to refer to the same or like parts.

A drying function may be included in a laundry machine so that the laundry machine may perform washing, rinsing and spinning functions, as well as drying the laundry after spinning. In a condensing type laundry machine, air drawn from the tub may have moisture removed therefrom by condensed water, and may be heated and then introduced back into the tub.

Figure 1:
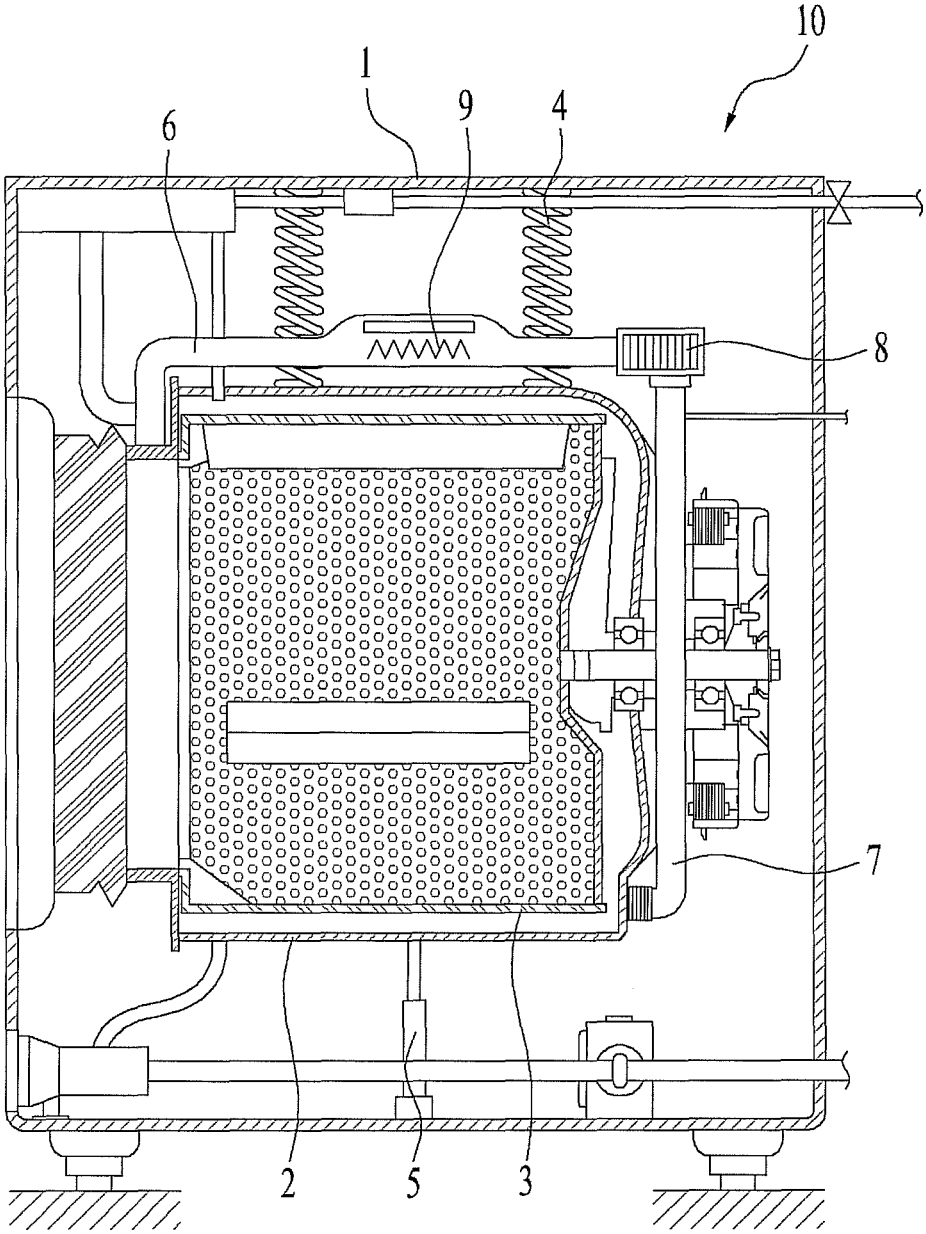
FIG. 1 is a side sectional view of an exemplary laundry machine.

Referring to FIG. 1, a condensing type laundry machine 10 may include a cabinet 1 which forms an exterior appearance thereof, a tub 2 provided in the cabinet 1, a drum 3 rotatably provided in the tub 2, a drying duct 6 and a fan 8 for circulating the air from the tub 2, and a heater 9 provided at the drying duct 6, a condensing duct 7 for guiding the air from the tub 2 to the drying duct 6 and condensing the air.

Installation of the condensing duct 7 at a rear of the tub 2 may limit the volume of the tub 2 and the drum 3, as the interior volume of the cabinet 1 is somewhat fixed. Further, if the air is circulated from the tub 2 through the fan 8, foreign matter (lint and the like) may be introduced to the condensing duct 7 together with the air, possibly introducing the foreign matter back into the drum 3, decreasing condensing efficiency and fan reliability, and overheating the heater 9.

Figure 2:
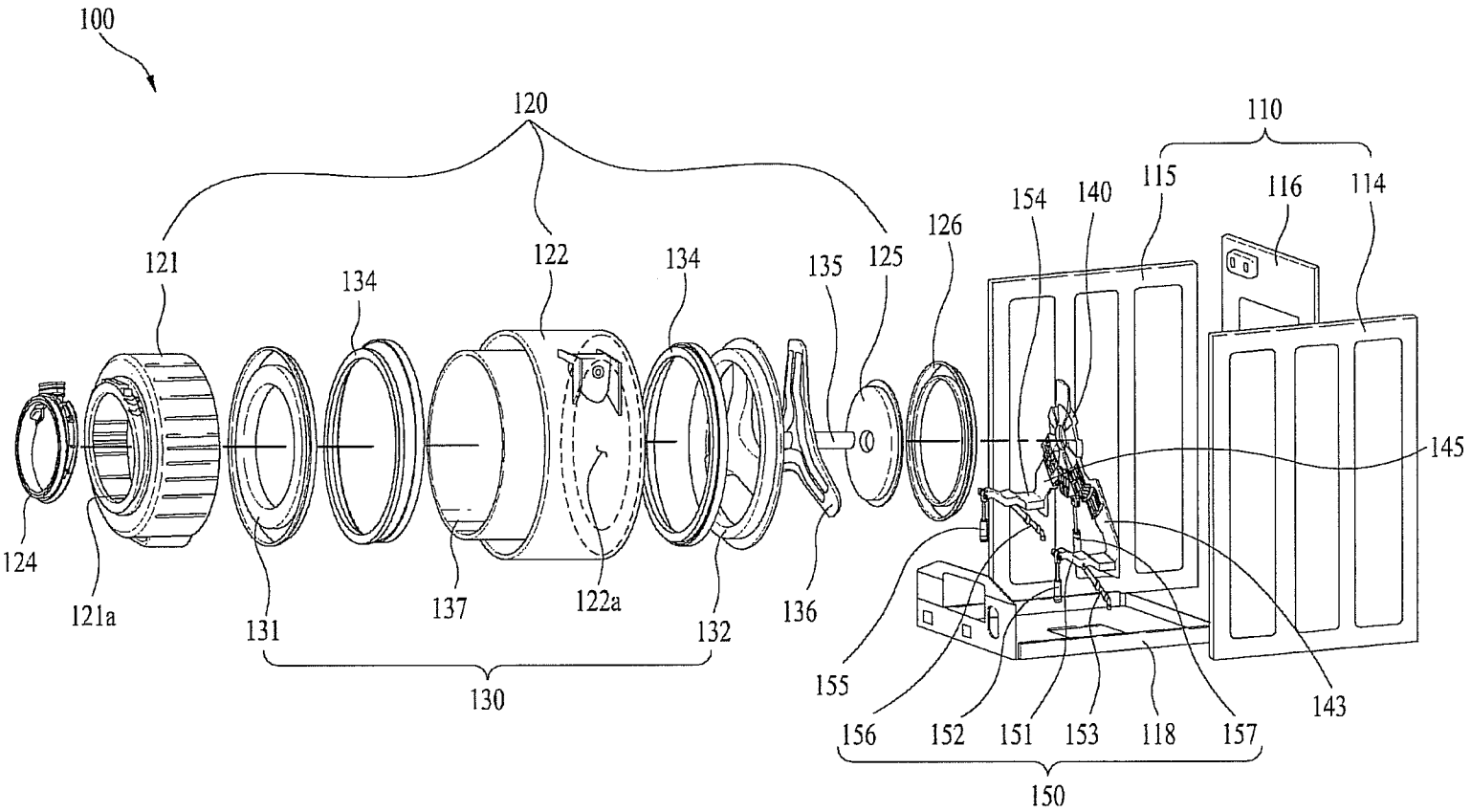
FIG. 2 is an exploded perspective view of a laundry machine in accordance with an embodiment as broadly described herein.
Figure 3:
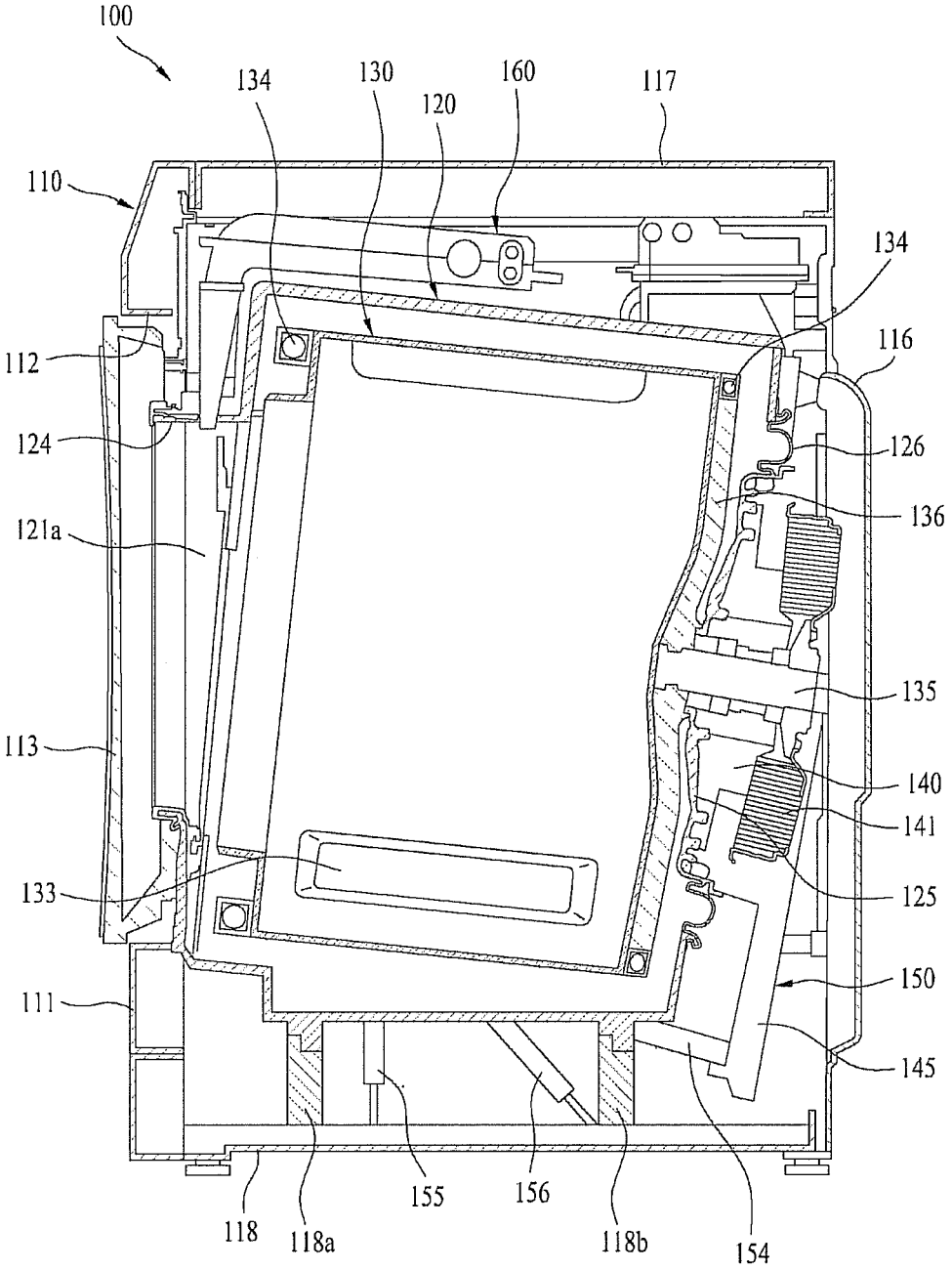
FIG. 3 is a side sectional view of an interior structure of the laundry machine shown in FIG. 2.

Referring to FIGS. 2 and 3, a laundry machine 100 as embodied and broadly described herein may include a cabinet 110 which forms an exterior appearance of the laundry machine 100, and a holding space provided in the cabinet 110 for receiving laundry items. The holding space may be defined only by the drum 130, or by a tub 120 fixedly secured to an inside of the cabinet 110, and a drum 130 rotatably provided within the tub 120. Simply for ease of discussion, a laundry machine in which the holding space includes the tub and the drum will be described hereinafter.

The laundry machine may also include a rotation shaft 135 connected to the drum 130 and passing through a rear of the tub 120, a bearing housing 140 which supports the rotation shaft 135, a driving motor 141 (See FIG. 3) provided at the bearing housing 140 for transmission of rotation force to the rotation shaft 135, and a suspension device 150 coupled to the bearing housing 140 for supporting structures connected to the bearing housing 140 and attenuating vibration and impact. An air supply device 160 for drying the laundry items, cooling down the laundry items after drying, removal of dust from the laundry items, and so on, may be provided. For example, in certain embodiments, the air supply device 160 may be fixedly secured to an outside of the tub 120 for supplying heated or unheated air to the inside of the tub 120 to dry, cool down, and remove dust or odor from the laundry items as described above.

The cabinet 110 may include a base 118 for supporting various components, a front panel 111 having an opening 112 provided therein for introducing the laundry into the drum 130, a left side panel 114, a right side panel 115, a rear panel 116, and a top panel 117, with a door 113 provided at the opening 112 for opening and closing the opening 112.

A water supply device including a water supply hose 127 (See FIG. 4) connected to an external source of water for supplying washing water to the tub 120, a water supply valve mounted on the water supply hose for controlling inflow and outflow of water, and a detergent supply device for holding detergent to be introduced into the tub 120 together with the water supplied through the water supply hose may be provided at a top interior portion of the cabinet 110. A drain device 129 (See FIG. 7) including a drain hose and a drain pump for draining the washing water used in washing or rinsing may be provided at a bottom interior portion of the cabinet 110.

Figure 4:
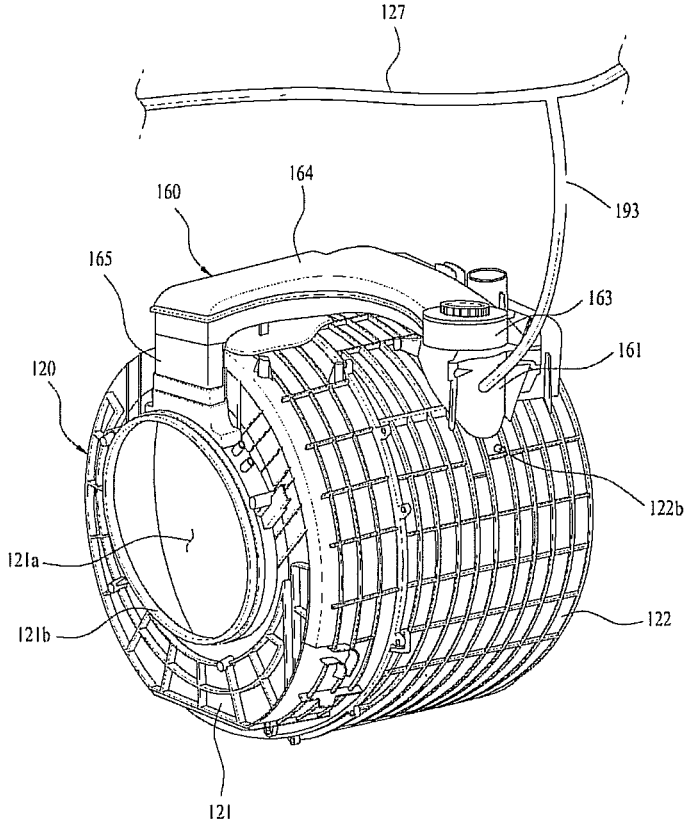
FIG. 4 is a perspective view of a tub and an air supply unit of the laundry machine shown in FIG. 2.

Referring to FIG. 4, the tub 120 may include a front tub 121 which forms a front portion thereof, and a rear tub 122 which forms a rear portion thereof. The front tub 121 and the rear tub 122 may be fastened together with fasteners, such as screws or the like, to form a space for housing the drum 130 therein. In this embodiment, the front tub 121 includes an opening 121*a* for introducing the laundry into the drum 130. The introduction opening 121*a* may include a rim portion 121*b* projected toward a front of the tub 120 from an inside circumference of the opening 121*a*.

The rim portion 121*b* may have an air delivery pipe 165 of the air supply device 160 connected thereto. A front gasket 124 may be provided at the rim portion 121*b* for maintaining air tightness between the opening 112 in the front panel 111 and the tub 120. The front gasket 124 may also prevent foreign matter from infiltrating between the tub 120 and the drum 130.

The rear tub 122 may have a pass through hole 122*a* formed through a rear of the tub 120, and the pass through hole 122*a* may be provided with a tub back wall 125 and a rear gasket 126. The rear gasket 126 may be connected between the tub back wall 125 and the pass through hole 122*a* in the rear tub 122 for preventing washing water from leaking from the inside of the tub 120.

The rear tub 122 may have a condensing water supply hole 122*b* formed in one side of an outer circumferential portion thereof for condensing moisture in air by using an inner circumferential surface of the rear tub 122. The condensing water supply hole 122*b* may allow the inner circumferential surface of the rear tub 122 to serve as a condensing surface due to cold water being supplied through the condensing water supply hole 122*b*.

The tub back wall 125 may vibrate together with the drum 130 when the drum 130 rotates. Therefore, an outer circumferential surface of the tub back wall 125 may be sufficiently spaced apart from the pass through hole 122*a* in the rear tub 122 for preventing the tub back wall 125 from interfering/colliding with the rear tub 122 when the drum 130 rotates.

The rear gasket 126 may be formed of a flexible material positioned between the tub back wall 125 and the pass through hole 122*a* in the rear tub 122, so that the tub back wall 125 may move relative to the rear tub 122 without interfering with the rear tub 122. The rear gasket 126 may have a corrugated portion extending to an adequate length for allowing the relative movement of the tub back wall 125.

Referring to FIG. 3, the tub 120 may be vertically supported by supporters 118*a* and 118*b* provided at the base 118 of the cabinet 110, as well as fastened with additional fasteners as appropriate, such as, for example, screws, bolts and the like. In addition to this, the tub 120 may be fastened to the front panel 111 and the rear panel 116, or to the left panel 114 and the right panel 115 of the cabinet 110 with fasteners as appropriate.

The drum 130 may include a front drum 131, a center drum 137, and a rear drum 132. Weight balancers 134 may be provided on, for example, a rear and a front of the front drum 131 and the rear drum 132 to provide a balancing action and attenuate the vibration of the drum 130 when the drum rotates. The center drum 137 may have lifts 133 provided on an inside surface for moving the laundry received in the drum 130.

The rear drum 132 may be coupled to a spider 136 connected to the rotation shaft 135 which provides a means for transmitting a rotation force of the rotation shaft 135 to the drum 130. Therefore, the drum 130 may rotate in the tub 120 in response to the rotation force of the rotation shaft 135 transmitted thereto through the spider 136.

In this embodiment, the rotation shaft 135 may be directly connected to a driving motor 141 and may pass through the tub back wall 125, with a rotor of the driving motor 141 directly connected to the rotation shaft 135, and the bearing housing 140 coupled to the rear of the tub back wall 125. The bearing housing 140 may rotatably support the rotation shaft 135 between the driving motor 141 and the tub back wall 125, and may be elastically supported by the base 118 through the suspension device 150.

The bearing housing 140 may have a first side coupled to the tub back wall 125 positioned at the rear of the tub 120, and the rotation shaft 135 may be coupled to the rotor of the driving motor 141 positioned at the other side of the bearing housing 140. The bearing housing 140 may include bearings to provide for smooth rotation of the rotation shaft 135, with the rotation shaft 135 supported by the bearings.

Figure 5:
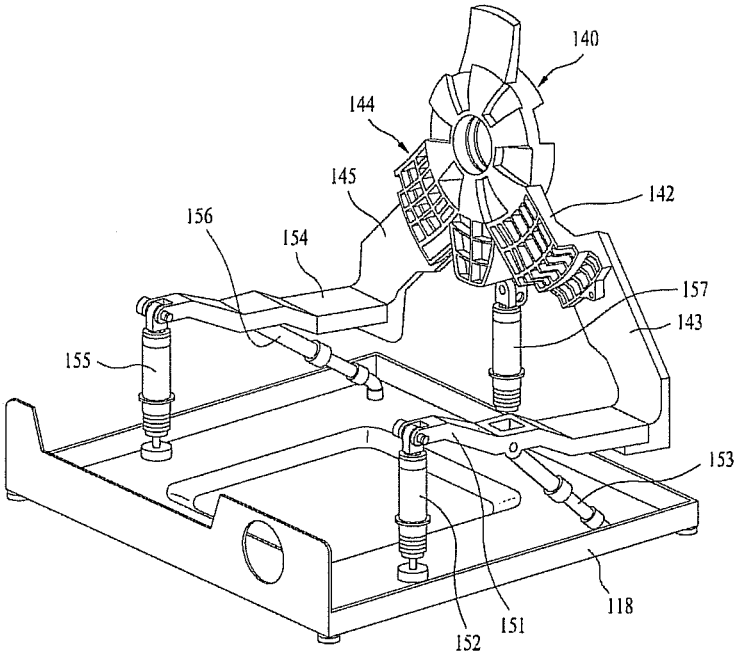
FIG. 5 is a perspective view of a suspension system of the laundry machine shown in FIG. 2.

Referring to FIG. 5, a first extension device 142 and a second extension device 144 may extend radially and symmetrically from left and right sides of the bearing housing 140. The first extension device 142 and the second extension device 144 may have the suspension device 150 fastened thereto, so that the bearing housing 140 is supported elastically by the suspension device 150.

Figure 6:
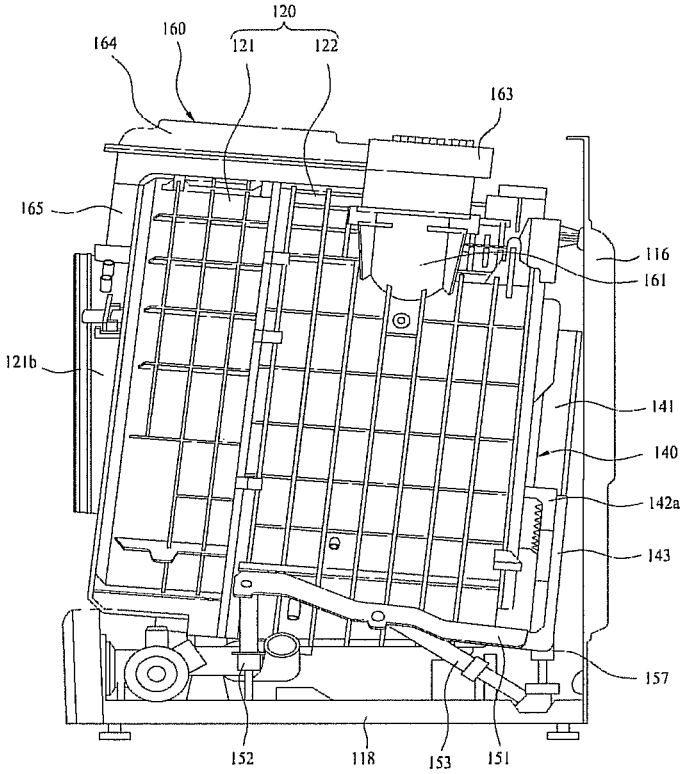
FIG. 6 is a side view of a coupled state of a tub to a suspension unit of a laundry machine in accordance with embodiments as broadly described herein.

The coupling of the suspension device 150 will be described in detail with reference to the FIGS. 5 and 6.

The suspension device 150 may have first and second weights 143 and 145 connected to the first and second extension devices 142 and 144 of the bearing housing 140, respectively, first and second suspension brackets 151 and 154 connected to the first and second weights 143 and 145, and first, second and third spring dampers 152, 155 and 157 and first and second dampers 153 and 156 connected to the first and second suspension brackets 151 and 154, and the bearing housing 140 to provide for elastic support of the bearing housing 140.

The first and second weights 143 and 145 may stably balance a center of weight of the drum 130 when the drum 130 has laundry items received therein, and may also serve as mass in a vibration system in which the drum 130 vibrates.

The first spring damper 152 may be connected between the first suspension bracket 151 and the base 118, and the second spring damper 155 may be connected between the second suspension bracket 154 and the base 118. The third spring damper 157 may be directly connected between the bearing housing 140 and the base 118. The bearing housing 140 may be attenuated and supported by the spring dampers 152, 155 and 157 at one place in rear of, and at two places in front of, the bearing housing 140.

The first damper 153 may be mounted at an incline between the first suspension bracket 151 and a rear portion of the base 118, and the second damper 156 may be mounted at an incline between the second suspension bracket 154 and the rear portion of the base 118.

In certain embodiments, the first and second weights 143 and 145, the first and second suspension brackets 151 and 154, the first and second spring dampers 152 and 155, and the first and second dampers 153 and 156 may be arranged symmetrically with respect to left/right directions of the rotation shaft 135 of the drum 130. The dampers may be connected to the base 118 with additional rubber bushings disposed therebetween so as to be coupled at a predetermined tilt angle between the first and second suspension brackets 151 and 154 and the base 118. According to this, the drum 130 and the bearing housing 140 may be supported by the first and second suspension brackets 151 and 154, and the first, second and third spring dampers 152, 155 and 157, such that the drum 130 floats within the tub 120.

The driving motor 141 may be fastened to the rear of the bearing housing 140 and directly connected to the rotation shaft 135. A speed of the driving motor 141 may be controlled by a controller.

The laundry machine as described above allows the tub to be separated from the vibration system, requiring only a very minimal amount of clearance between the drum and the tub, and the tub and the cabinet. Thus, this laundry machine may maximize a tub capacity for laundry machines having the same cabinet interior space and exterior appearance.

The laundry machine shown in FIG. 1 has a tub secured to an inside of a cabinet with springs 4 and/or dampers 5, a drum 3 rotatably provided in the tub 2, and a driving motor provided at a rear of the tub 2 for rotating the drum 3. In this arrangement, vibration caused by the drum 3 or the driving motor as the drum 3 rotates is transmitted to the tub 2, requiring a predetermined space between the tub 2 and the cabinet 1 for preventing collision (which generates noise and vibration) from taking place between the cabinet 1 and the tub 2 when the tub 2 vibrates. In contrast, if the tub is excluded, or separated from, the vibration system, as in the arrangement shown in FIGS. 2 and 3, a space between the tub and the cabinet is not required, and tub capacity may be maximized for the same cabinet interior space/capacity.

Referring to FIG. 4, the air supply device 160 may be provided above the tub 120 for circulating the air in the tub 120 during an air supply cycle of the laundry machine 100. The air supply cycle may supply heated or unheated air to an inside of the tub 120 for treating the laundry received therein, such as in a drying cycle. In a case in which heated air is supplied to the inside of the tub 120, the air supply device 160 may both circulate and heat the air. That is, the air supply device 160 may be configured to draw the air from the tub 120 to an outside of the tub 120, to heat the air, and to supply the air heated back to the tub 120.

The air supply device 160 may include an air collection pipe 161 formed at an outer circumferential surface portion of the tub 120, an air moving device 163, such as, for example, a fan, for moving the air from the inside of the tub 120 to the air collection pipe 161, a duct 164 for guiding the air introduced into the air collection pipe 161 by the fan 163 to a front of the tub 120, a heater in the duct 164 for heating the air flowing in the duct 164, and an air delivery pipe 165 for guiding the heated air to the inside of the tub 120. The air collection pipe 161 may pass through the circumferential surface of the tub 120 (the circumferential surface of the tube 120 being a surface that connects the front surface to the rear surface).

Figure 7:
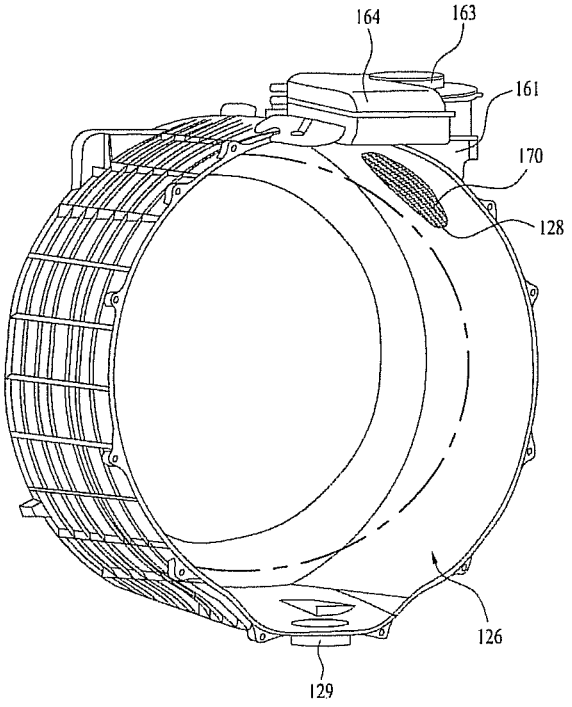
FIG. 7 is a perspective view of a tub of a laundry machine in accordance with embodiments as broadly described herein.
Figure 8:
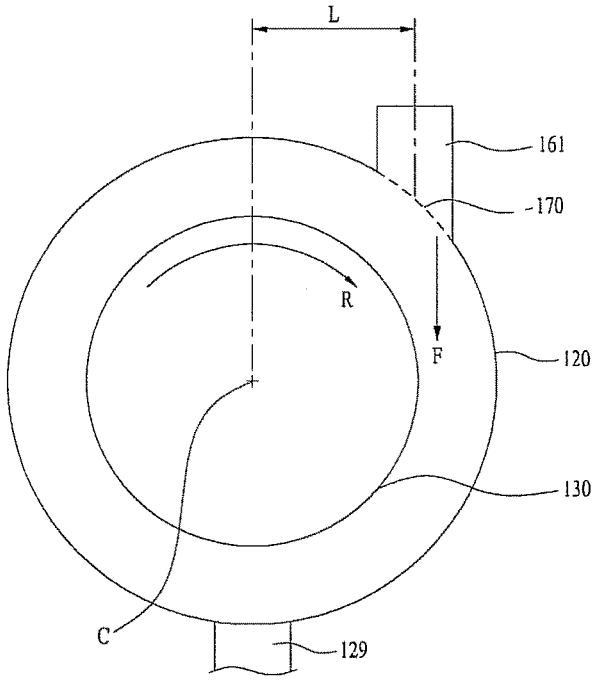
FIGS. 8 and 9 illustrate a filter and a filter cleaning device of a laundry machine, in accordance embodiments as broadly described herein.

Referring to FIGS. 7 and 8, the air collection pipe 161 may pass through the circumferential surface of the tub 120 and be coupled to a communication hole 128 provided at a position spaced a predetermined distance L from a rotation center C of the drum 130. The communication hole 128 in the tub 120 may have a filter 170 provided thereto for filtering the foreign matter (lint and the like) from the air being discharged from the tub 120, and a filter cleaning device 190 (See FIG. 9) provided at an inside of the air collection pipe 161 for cleaning the foreign matter deposited on the filter 170.

Figure 9:
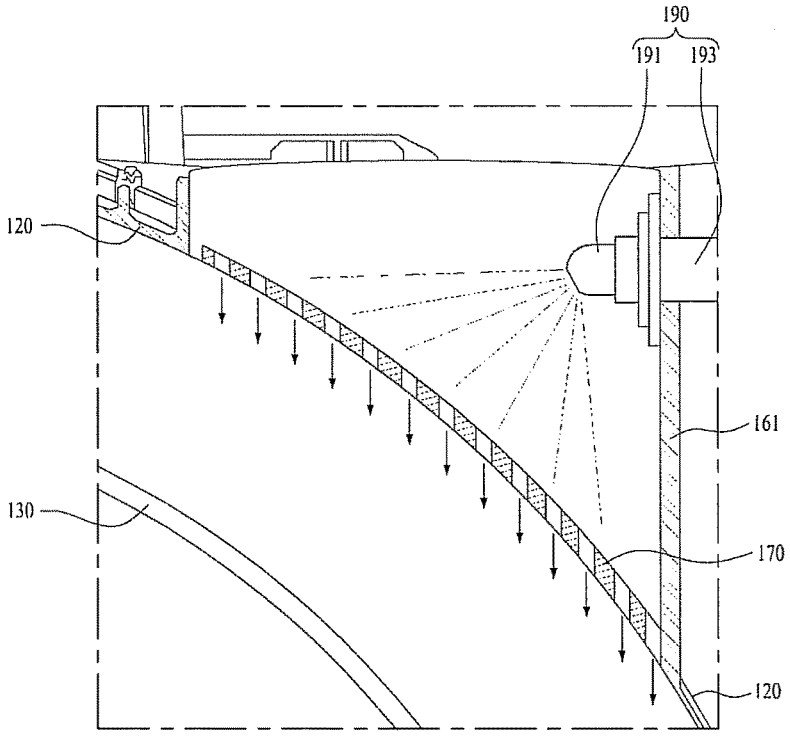

FIGS. 7 to 9 illustrate a case in which a surface of the filter 170 forms a corresponding inner circumferential surface portion of the tub 120. Such a filter 170 may have the same radius of curvature as that of the tub 120, with a larger area of the filter 170 providing a better filtering effect. However, this is simply an example, and the filter 170 may instead be positioned in the air collection pipe 161.

The fan 163 may be provided at a top side of the air collection pipe 161. As the fan 163 is put into operation, the air may move from the inside of the tub 120 toward the duct 164 through the air collection pipe 161. The air introduced into the duct 164 by the fan 163 may be heated by the heater, and supplied to the inside of the tub 120 through the air delivery pipe 165 to dry the laundry.

In certain embodiments, the filter 170, which filters foreign matter from air being introduced into the air collection pipe 161 from the air supply device 160, may have foreign matter deposited on the filter 170 removed therefrom when the filter 170 is used for a long period of time. For this, the laundry machine may further include a filter cleaning device 190 as shown in FIG. 9.

The filter cleaning device 190 may supply cleaning water to the filter 170 so that the foreign matter deposited on the filter 170 is introduced to the inside of the tub 120, and discharged to an outside of the laundry machine through the drain device 129 that drains the washing water from the inside of the tub 120. That is, the filter cleaning device 190 may spray cleaning water from the top side of the filter 170 to the inside of the tub 120 so as to release the foreign matter from the filter 170 and direct it to the inside of the tub 120.

For this, the filter cleaning device 190 may include a nozzle 191 provided at the air collection pipe 161 for spraying the cleaning water onto the filter 170, and a cleaning water supply pipe 193 for supplying the cleaning water to the nozzle 191. The cleaning water supply pipe 193 may be directly connected to an external water supply source, or may be connected to the supply hose 127 which supplies washing water to the tub 120.

In certain embodiments, a valve may be provided at a connection portion of the supply hose 127 and the cleaning water supply pipe 193 for selective opening of the supply hose 127 and the cleaning water supply pipe 193.

A filter cleaning device, in accordance with embodiments as broadly described herein, may have a structure shown in FIGS. 10 to 13. The filter cleaning device 200 shown in FIG. 10 may be provided over the filter 170, between the filter 170 and the fan 163, for spraying cleaning water downward to the inside of the tub 120.

The filter cleaning device 200 may be connected to the cleaning water supply pipe 193, and may include a fastening portion 210 having a hollow structure through which cleaning water may flow, a body 220 extended from the fastening portion 210 to position in the air collection pipe 161, and a cleaning water spray portion 230 fastened to an underside of the body 220 for spraying the cleaning water from the fastening portion 210 onto the filter 170. The fastening portion 210 may have a shape of a tube or a pipe fastened to the air collection pipe 161. The fastening portion 210 may be provided to the air collection pipe 161, oriented vertically with respect thereto, to prevent leakage and provide for easy fastening.

Figure 10A:
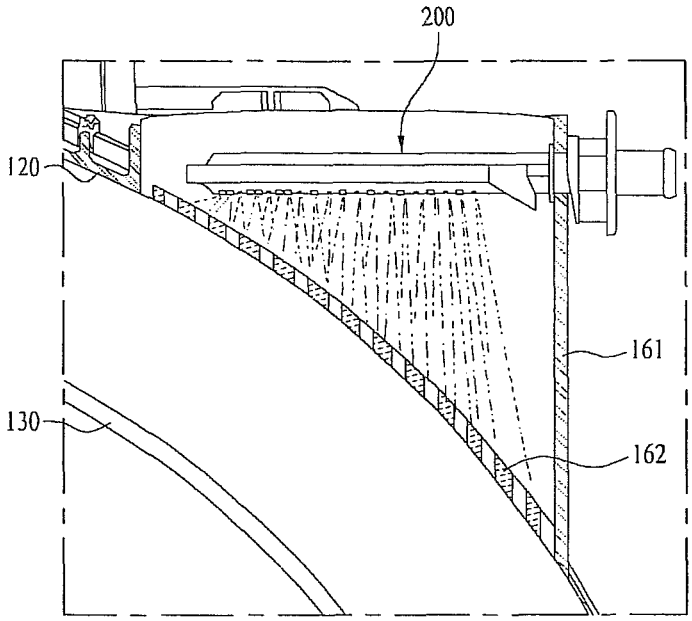
Figure 10B:
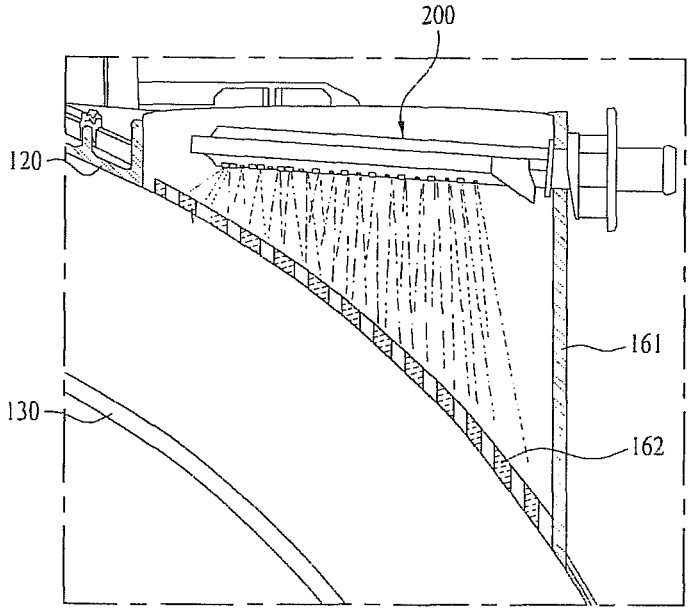

As discussed above, in one embodiment the body 220 and the cleaning water spray portion 230 may be oriented vertically with respect to the air collection pipe 161 as shown in FIG. 10A. However, in alternative embodiments, the body 220 and the cleaning water spray portion 230 may be instead be tilted at a predetermined angle such that an end of the body 220 is at a higher position than a portion of the body 220 which is coupled to the fastening portion 210, as shown in FIG. 10B. Such an orientation may increase a spray radius of the cleaning water and applying a stronger impact force to the foreign matter deposited on the filter 170 by increasing a distance between the cleaning water spray portion 230 and the filter 170.

Figure 11:
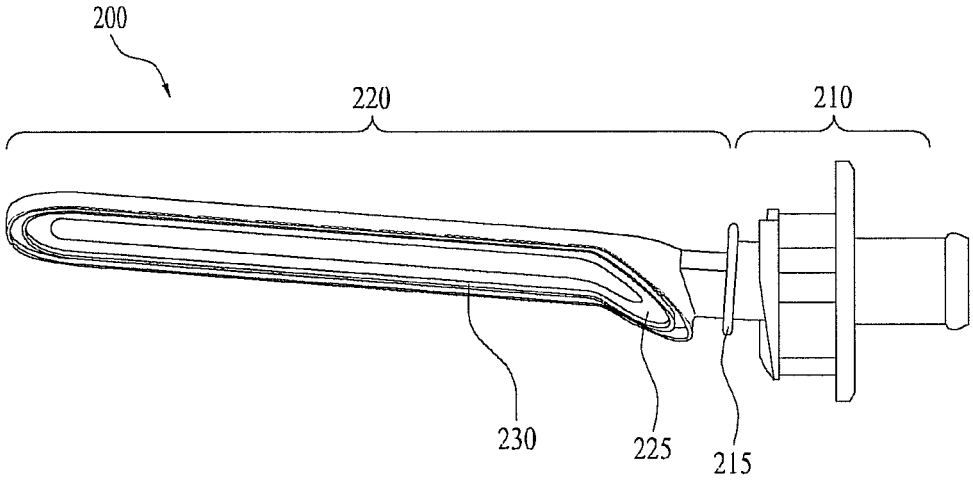

Referring to FIG. 11, in order to prevent the cleaning water from leaking to an outside of the air collection pipe 161 when the cleaning water is sprayed, the fastening portion 210 may include a fastening rib 215 extending from an outer circumferential surface of the fastening portion 210. The fastening rib 215 may also make fastening of the filter cleaning device 200 to the air collection pipe 161 more rigid.

As discussed above, the filter cleaning device 200 may have the same area as that of the filter 170 to facilitate removal of the foreign matter. However, if the area of the filter cleaning device 200 is the same as the area of the filter 170, an air flow toward the air collection pipe 161 may interfere with the filter cleaning device 200.

Thus, in certain embodiments, the filter cleaning device 200 may be shaped to minimize interference with the air flow, such as, for example, the body 220 may have a bar shape.

The body 220 may also include a leak prevention step 225 at the proximal end thereof, sloped toward the fastening portion 210 to prevent the cleaning water from leaking to an outside of the air collection pipe 161 when the cleaning water is sprayed.

Figure 12:
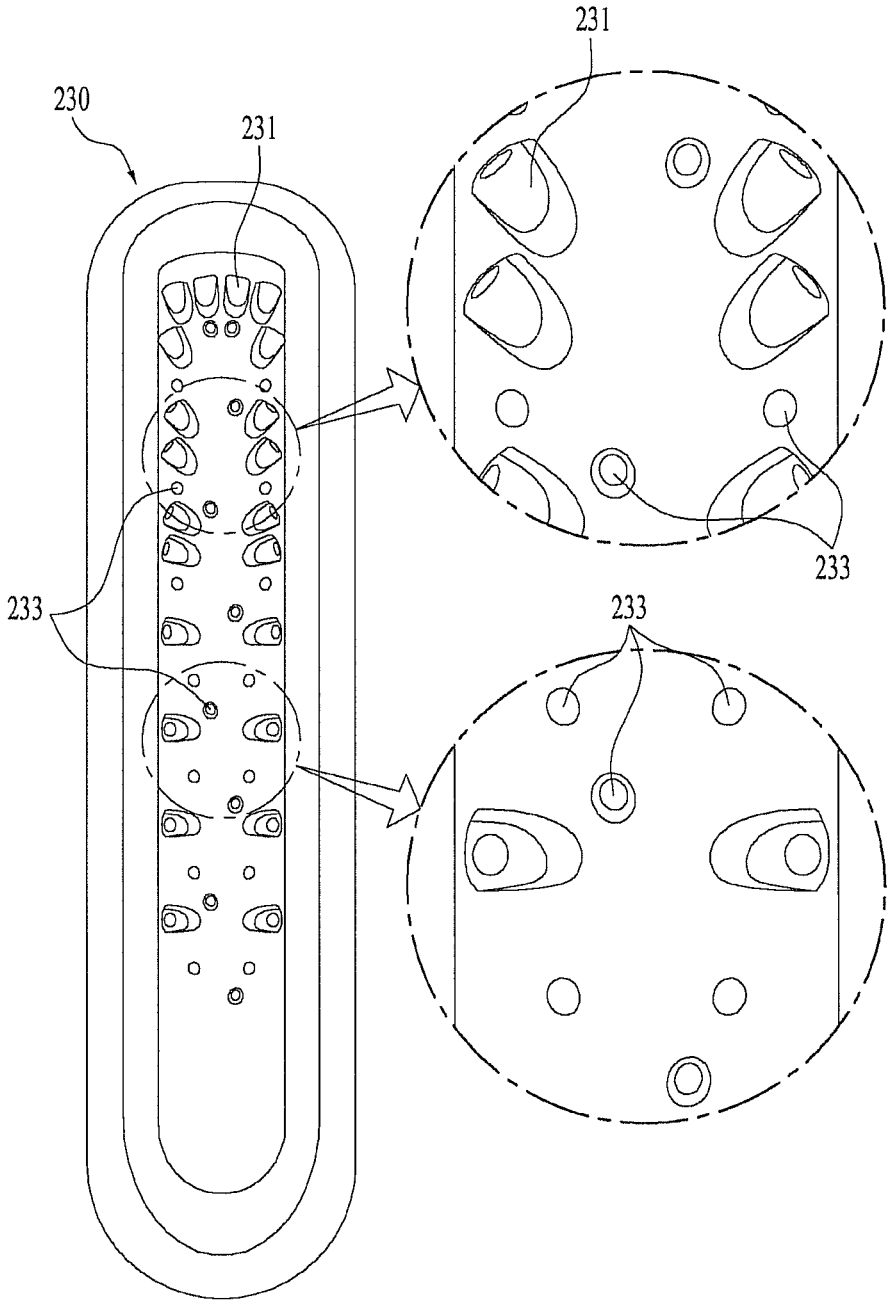
Figure 13:
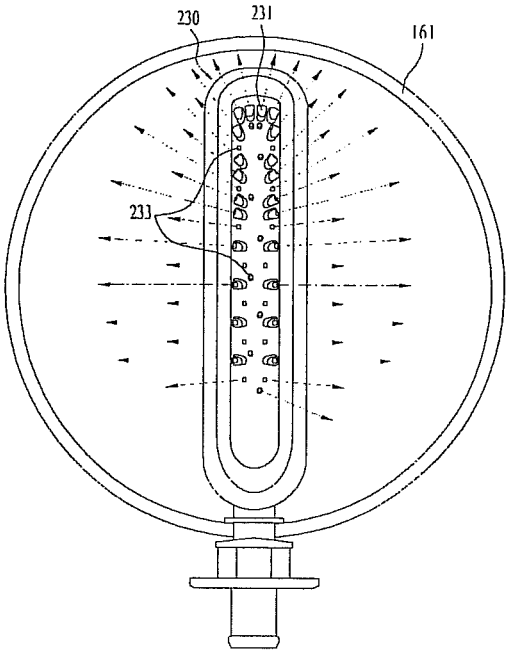

As shown in FIG. 12, the cleaning water spray portion 230 may include one or more first spray nozzles 231 and one or more second spray nozzles 233. A side of the cleaning water spray portion 230 facing the filter 170 may have a convex curved shape, and the first spray nozzles 231 may be arranged at predetermined intervals along an edge of the cleaning water spray portion 230 for spraying the cleaning water onto the filter 170. The second spray nozzles 233 may be positioned in a space formed between the first spray nozzles 231 (including a center portion of the cleaning water spray portion 230) for spraying the cleaning water onto the filter 170.

So that the first spray nozzles 231 spray the cleaning water in a radial direction with reference to a center of the cleaning water spray portion 230, the first spray nozzles 231 may project from a surface of the cleaning water spray portion 230. This may enlarge a spray radius of the cleaning water being sprayed through the first spray nozzles 231 (see FIG. 13). The first spray nozzle 231 may have a spray hole formed in a projected face thereof, so that that the cleaning water may be sprayed from the first spray nozzle 231 toward the edge of the filter 170.

In certain embodiments, the first spray nozzles 231 and the second spray nozzles 233 may be symmetrically arranged with respect to a longitudinal axis of the cleaning water spray portion 230.

When so arranged, since a spray area of the cleaning water sprayed from the first spray nozzle 231 and the second spray nozzle 233 is larger than an area of the filter 170, even when the filter cleaning device 200 is formed in a bar shape, the filter cleaning device 200 may effectively clean the entire filter 170.

In certain embodiments, the fastening portion 210, the body 220, and the cleaning water spray portion 230 of the filter cleaning device 200 may be manufactured by injection molding. The fastening portion 210 and the body 220 may be injection molded as one unit in one process, and the cleaning water spray portion 230 may be injection molded separately in view of a structural nature of the first spray nozzle 231. In this case, the body 220 and the cleaning water spray portion 230 may be coupled together by fusion or other attachment methods as appropriate.

An air supply cycle of a laundry machine 100 having the foregoing structure will now be described.

The air supply cycle of a laundry machine 100 as embodied and broadly described herein may be a cycle in which heated or unheated air is supplied to an inside of a space in which laundry items are received for drying, cooling down heated laundry items, or removal of odor or dust from the laundry items. However, simply for ease of discussion, the air supply cycle will be described with reference to a process in which heated air is supplied to the receiving space provided by the tub and the drum for treating the laundry items.

Referring to FIG. 4, if the fan 163 is rotated during the air supply cycle, air may be introduced into the duct 164 from the inside of the tub 120 through the air collection pipe 161 and heated by the heater provided in the duct 164. The heated air may be supplied to the inside of the tub 120 through the air delivery pipe 165, where it undergoes heat exchange with the laundry items received in the drum, to absorb moisture from the laundry items.

The heated air which has absorbed moisture from the laundry is then discharged from the tub 120 through the air collection pipe 161 connected between the tub 120 and the duct 164. In this process, an inner circumferential surface of the tub 120 and a space between the tub 120 and the drum 130 may function as a condensing duct which removes the moisture from the heated air.

Since an outer circumferential surface of the tub 120 is in contact with cold external air, the inner circumferential surface of the tub 120 and the space between the inner circumferential surface of the tub 120 and outer circumferential surface of the drum 130 may have a temperature that is lower than temperature inside the drum 130.

The heated air which has been supplied to the inside of the drum 130, has absorbed moisture from the laundry, and has been discharged from the drum 130 may be condensed at the inner circumferential surface of the tub 120 while moving toward the air collection pipe 161, and the air condensed and collected at the inner circumferential surface of the tub 120 (condensed water) may be drained to the outside of the tub 120 through the drain device 129 (see FIG. 7).

Therefore, since in the laundry machine 100 as embodied and broadly described herein the inner circumferential surface of the tub 120 and the space between the inner circumferential surface of the tub 120 and the outer circumferential surface of the drum 130 function as a condensing duct, the laundry machine 100 does not require a separate condensing duct for cooling down the heated air.

If cooling water is supplied to the inside of the tub 120 through the condensing water supply hole 122*b*, the air condensing function of the tub 120 may be further enhanced.

The heated air, which has had the moisture removed therefrom by the inner circumferential surface of the tub 120 and the space between the inner circumferential surface of the tub 120 and the outer circumferential surface of the drum 130, may be introduced into the duct 164 through the air collection pipe 161, heated again, and supplied to the inside of the tub 120 through the air delivery pipe 165, to repeat the process described above for drying the laundry items received in the drum 130.

The heated air supplied to the inside of the tub 120 through the air delivery pipe 165 may contain foreign matter, such as lint, as the heated air is recirculated. The laundry machine 100 may include the filter 170 provided at the communication hole 128 (see FIG. 7) or the inside of the air collection pipe 161, to prevent the foreign matter from entering into the air supply device 160.

Foreign matter removed from the heated air may be deposited on one face of the filter 170, having a detrimental effect on efficiency (drying efficiency, and so on) of the air supply cycle due to reduction of an air flow rate to the air collection pipe 161. In order to reduce this, the laundry machine 100 may include the filter cleaning device 190 or 200 shown in FIGS. 9 to 13 to clean the filter 170.

The filter cleaning device 190 or 200 may be provided in the air collection pipe 161 over the filter 170, and may include a nozzle 191 for spraying the cleaning water toward the inside of the tub 120 to introduce the foreign matter deposited on the face of the filter 170 facing the tub 120 to the inside of the tub 120 and to discharge it to the outside of the tub through the drain device 129.

In certain embodiments, a process for cleaning the filter 170 using the filter cleaning device 190 or 200 may be performed while the fan 163 is not rotated.

If the filter 170 is cleaned by spraying cleaning water onto the filter 170, a water film may be formed on the filter 170 right after cleaning. Such a water film may make it difficult to discharge air from the inside of the tub 120 to the outside of the tub 120 through the air collection pipe 161, thus degrading efficiency during the air supply cycle.

A size of the holes in the filter 17 may be enlarged to facilitate removal of the water film, but this may degrade filtering of foreign matter, and may not be sufficiently effective in removing the water film. Applicants have determined that a major reason for the formation of the water film after the filter cleaning process is rotation of the fan while the filter is being cleaned.

Figure 14:
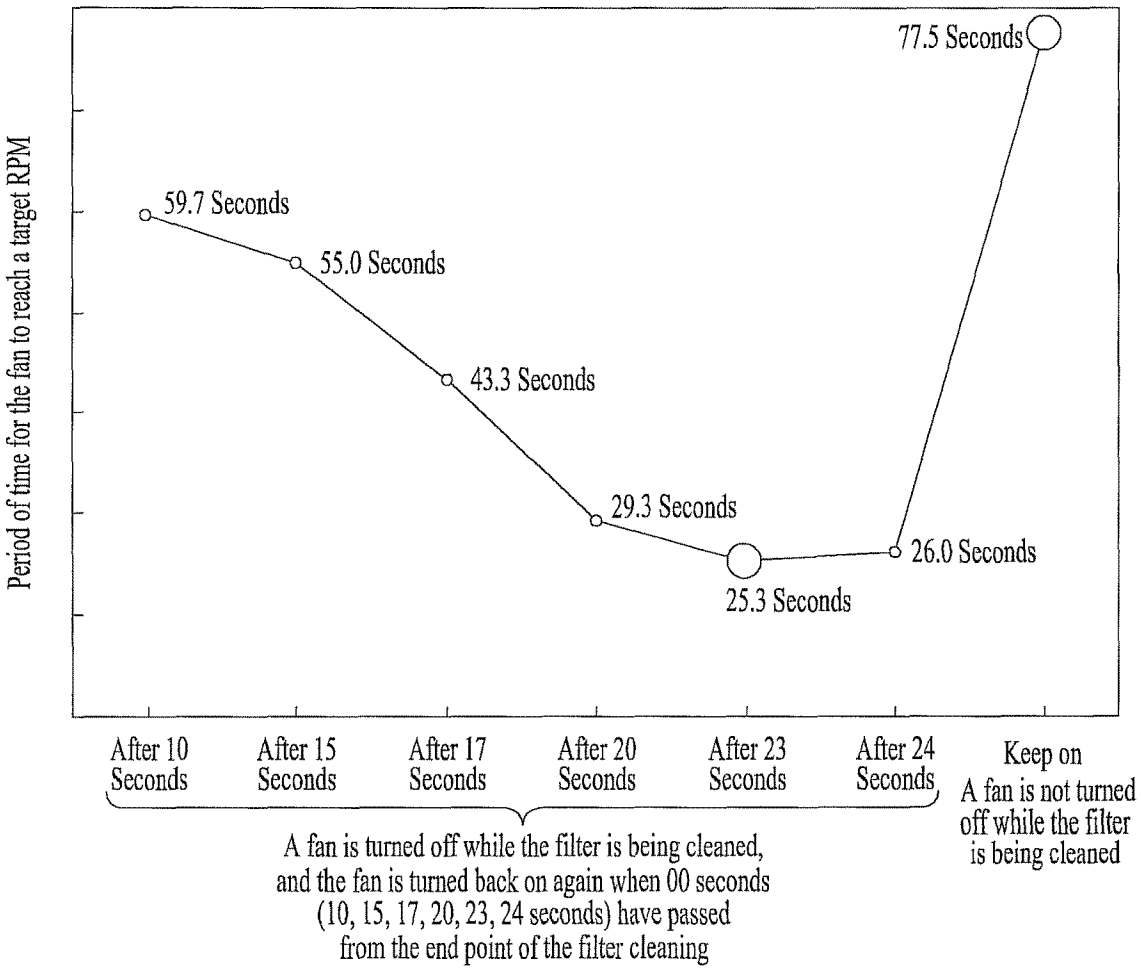
FIG. 14 is a graph of water film removal time from a filter based on fan operation.

FIG. 14 is a graph showing data measured over a period of time for the fan to reach to a target RPM (about 170 to 180 RPM) representing a period of time for removal of the water film, versus a waiting time from the end point of a filter cleaning to a point at which fan operation is resumed. Referring to FIG. 14, if the fan is not turned off while the filter is being cleaned, it takes approximately 77.5 seconds for the fan to reach to the target RPM. However, if the fan is turned off while the filter is being cleaned, and turned back on about 23 seconds after the filter cleaning is finished, it takes approximately 25.3 seconds for the fan to reach to the target RPM.

As shown in FIG. 9, cleaning water is sprayed from the nozzle 191 of the filter cleaning device 190 in a direction toward the inside of the tub 120, the air in the tub 120 moves in a direction opposite to the moving direction of the cleaning water when the fan 163 is rotated. In the end, rotation of the fan 163, which discharges the air to the outside of the tub 120, is a major cause of the water film that prevents the cleaning water sprayed onto the filter 170 from dropping freely to the inside of the tub 120, causing it to instead stay on a surface of the filter 170. Therefore, a laundry machine 100 as embodied and broadly described herein may be controlled such that the cleaning water is sprayed onto the filter 170 after the fan 163 is turned off, thus minimizing a time period in which the water film is maintained at the filter 170, or preventing the water film from forming on the filter 170.

The cleaning water sprayed onto the filter 170 is introduced to the inside of the tub 120 through the communication hole 128 of the tub 120. As shown in FIG. 8, since the communication hole 128 is provided at a position spaced a predetermined distance L from the rotation center C of the drum 130, the cleaning water introduced into the inside of the tub 120 moves to the drain device 129, along the inner circumferential surface of the tub 120, or a space between the drum 130 and the tub 120. Therefore, a laundry machine as embodied and broadly described herein may prevent or minimize the laundry items received in the drum 130 from being wet by the cleaning water, even if the filter 170 is cleaned by the filter cleaning device 190.

Since a temperature of the inner circumferential surface of the tub 120 is decreased by the cleaning water sprayed from the filter cleaning device 190, the laundry machine 100 may experience increased condensing efficiency at the inner circumferential surface of the tub 120, and the space between the drum 130 and the tub 120.

In certain circumstances, when the foreign matter is removed from the filter 170 by supplying the cleaning water to the filter 170, the water film may be formed on the surface of the filter 170, depending on a structure of the filter 170, even if the fan 163 is turned off. This is because, in general, the filter 170 may have a net form including a plurality of holes. If a size of the holes is (too) small, surface tension of the cleaning water may make foreign matter present at the filter 170 wet and easy to stick to the filter 170. Thus, the cleaning water sprayed from the nozzle 191 may block the holes in the filter 170 for a time period, preventing the air from entering into the air collection pipe 161.

In order to solve such a problem, a laundry machine 100 as embodied and broadly described herein may be controlled such that, not only is the cleaning water sprayed onto the filter 170 after the fan 163 is turned off, but also the drum 130 is rotated so as to prevent the water film from forming on the surface of the filter 170. That is, if the drum 130 is rotated while the filter 170 is cleaned, an air flow is generated in the tub 120, and the air flow generated at the inside of the tub 120 may separate the cleaning water from the surface of the filter 170.

As described above, the communication hole 128 having the filter 170 provided thereto may be spaced a predetermined distance L from the rotation center C of the drum 130. In this case, the drum 130 may be controlled to rotate in a direction R as the cleaning water sprayed from the nozzle 191 drops to the inside of the tub 120 in a direction F (see FIG. 8). This may allow the cleaning water introduced into the inside of the tub 120 through the filter 170 to move toward, not the inner circumferential surface of the drum 130, but the inner circumferential surface of the tub 120, even if the cleaning water drops on the surface of the drum 130.

A method for controlling a laundry machine having an air supply cycle, as embodied and broadly described herein, will be described with reference to FIG. 15. The method shown in FIG. 15 may include a first filter cleaning cycle S100, an air supply cycle S200, and a second filter cleaning cycle S300.

As described above, during the air supply cycle S200, heated or unheated air is supplied to an inside of a tub 120 for treating laundry items held in a drum 130, the air supply cycle including a step S210 for initiating operation of a fan 163 and rotating the drum. If the items are to be treated using heated air, a step S220 for initiating operation of a heater may be included.

In certain embodiments, the drum rotating step may be omitted. However, efficiency of the air supply cycle (the drying cycle, and the like) may be enhanced by rotating the drum 130 as described above.

If the drum rotating step is included, the drum rotating step may be performed at substantially the same time as initiating operation of the fan S210. Alternatively, a separate drum rotation step may be performed, before or after initiating operation of the fan. In either case, the step S220 for initiating operation of a heater may be performed after the step S210 for putting the fan into operation, to prevent the heater from overheating.

In a step S230, it may be determined whether or not cleaning of the filter 170 is required. The step S230 may be performed by, for example, sensing whether or not an amount of foreign matter deposited on the filter has reached to a preset amount. The amount of foreign matter deposited on the filter may be determined in a variety of ways.

For example, determining whether or not cleaning of the filter is required may be performed by sensing a number of revolutions RPM of the fan 163, and a change rate of the number of revolutions of the fan (or, a changed amount of the number of revolutions). If the filter has a relatively small amount of foreign matter deposited thereon, a flow rate of the air introduced into the duct 164 through the air collection pipe 161 will be relatively high, and the flow rate of the air introduced through the air collection pipe 161 acts as a load on the fan 163. Therefore, if power supplied to the fan 163 is constant, the smaller the amount of the foreign matter deposited on the filter, the lower the RPM of the fan, and, the larger the amount of foreign matter deposited on the filter (the lower the flow rate of the air introduced into the air collection pipe), the higher the RPM of the fan.

The step S230 for determining whether or not cleaning of the filter 170 is required may be provided such that a cleaning time of the filter 170 is determined by determining whether or not the RPM of the fan 163 is higher than a preset RPM when a fixed power is supplied to the fan 163.

In certain circumstances, determining whether or not cleaning of the filter is required based on whether or not the RPM of the fan has reached a preset RPM may not always be accurate. For example, referring to FIG. 16, there may be sections (P-transient, Q1, Q2—a case when the water film is formed at the filter) in which the RPM of the fan is abnormally high (just after operation is initiated) before the rotation of the fan is stabilized. If the cleaning time of the filter is determined by the method described above, this may cause the filter to be cleaned even if the filter is not blocked.

Therefore, it may be more appropriate in the step S230 if this is determined based on an amount of change of RPM of the fan. That is, the step S230 for determining whether or not cleaning of the filter is required may be performed by determining whether or not the RPM of the fan has increased to a preset RPM (250~300 RPM) from a lowest RPM of the fan measured after the step S210 operation of the fan is initiated.

If it is determined that cleaning of the filter is required at the step S230, the control method may progress to a step S240 for removing the foreign matter from the filter. The step S240 for removing the foreign matter from the filter may include a step S241 for turning off the fan, and a step S242 for supplying the cleaning water to the filter 170 using the filter cleaning device 190 or 200 to cause the foreign matter deposited on the filter 170 to move to the inside of the tub 120.

As described above, supplying the cleaning water to the filter is performed after the fan is turned off to prevent the water film from forming at the filter and preserve the efficiency of the air supply cycle.

The step S240 for removing foreign matter from the filter may further include a step S243 for accelerating the drum, and in certain embodiments, accelerating the drum while the step S242 for supplying the cleaning water to the filter is in progress.

Since in the step for rotating the drum (the drum is rotated at an RPM1 in a direction R in FIG. 8, for example, an RPM1 of 40 to 50 RPM) the cleaning water is directed to the inside of the tub and is started at an initial stage of the air supply cycle S200, even if the water film is formed on the filter 170 in the step S242 for supplying the cleaning water to the filter, the water film can be removed by an air flow inside of the tub caused by the rotation of the drum.

Therefore, though in certain embodiments the drum accelerating step S243 may be omitted, if the drum accelerating step S243 in which the drum is rotated at a rotation speed RPM2 higher than the rotation speed of the drum in the drum rotation step is provided to the foreign matter removing step S240, removal of the water film may be accomplished more quickly.

As an example, though the rotation speed RPM2 of the drum in the drum accelerating step S243 may be about 95 to 105 RPM, since a highest rotation speed of the drum at which no sensing of eccentricity of the drum (UB sensing) is required is about 100 RPM, the RPM2 may be set to be 100 RPM.

If the drum is rotated with laundry items received in the drum, though the drum may be rotated eccentrically by a weight of the items, 100 RPM is essentially the highest rotation speed at which eccentricity sensing is not required for preventing eccentric rotation of the drum.

The step S240 for removing foreign matter from the filter may be completed by a step S244 for determining whether or not a time period T in which the cleaning water is supplied to the filter has reached a preset time period Ts2, and a step S245 of stopping the cleaning water supply to the filter if the time period T has reached the preset time period Ts2.

Upon finishing the step S240 for removing foreign matter from the filter, a step S250 for circulating the air inside the tub by putting the fan into operation, and a step S260 for decelerating the drum (reducing a rotation speed from the RPM2 to a rotation speed, RPM1 or the like, lower than the RPM2) may be initiated, either at the same time or in succession.

However, if the step S250 for circulating the air inside the tub by putting the fan into operation is preformed after a certain period of time has elapsed since the cleaning water supply was stopped at the step S245, removal of the water film from the filter may be more effective.

The air supply cycle S200 may be completed after determining at step S270 whether or not a preset time period for the air supply cycle S200 has elapsed, and then turning off the heater, turning off the fan, and stopping rotation of the drum, at the same time or in succession, at the step S280.

A control method as embodied and broadly described herein may also include at least one of a first filter cleaning step S100 for cleaning the filter before starting the air supply cycle S200, and a second filter cleaning step S300 for cleaning the filter after finishing the air supply cycle S200.

The first filter cleaning step S100 may enhance efficiency of the air supply cycle S200 by removing foreign matter from the filter before starting the air supply cycle S200, and the second filter cleaning step S300 may prevent foreign matter remaining on the filter from sticking to the filter after the air supply cycle S200 is finished.

In general, the fan 163 is not rotated if the air supply cycle S200 is performed, not in succession to the washing cycle, the rinsing cycle, the spinning cycle, and so on, but independently. Therefore, if the first filter cleaning step S100 is performed before the air supply cycle S200 performed independently, the first filter cleaning step S100 may include only a step S130 for supplying cleaning water to the filter, a step S140 for determining whether or not a time period T in which the cleaning water is supplied to the filter has reached to a preset time period Ts1, and a step S150 for stopping the supply of cleaning water to the filter.

However, if the air supply cycle S200 is performed in succession to the washing cycle, the rinsing cycle, and the spinning cycle, the first filter cleaning step S100 may include a step S110 for determining whether or not the fan is in operation, and a step S120 for turning the fan off if it is determined that the fan is in operation, in addition to the step S130 for supplying the cleaning water to the filter. That is, if the filter cleaning step S130 is performed while the fan is in operation, the water film may be formed at the filter by the step S210 for putting the fan into operation in the air supply cycle S200, which is performed in succession to the first filter cleaning step S100.

Figure 15:
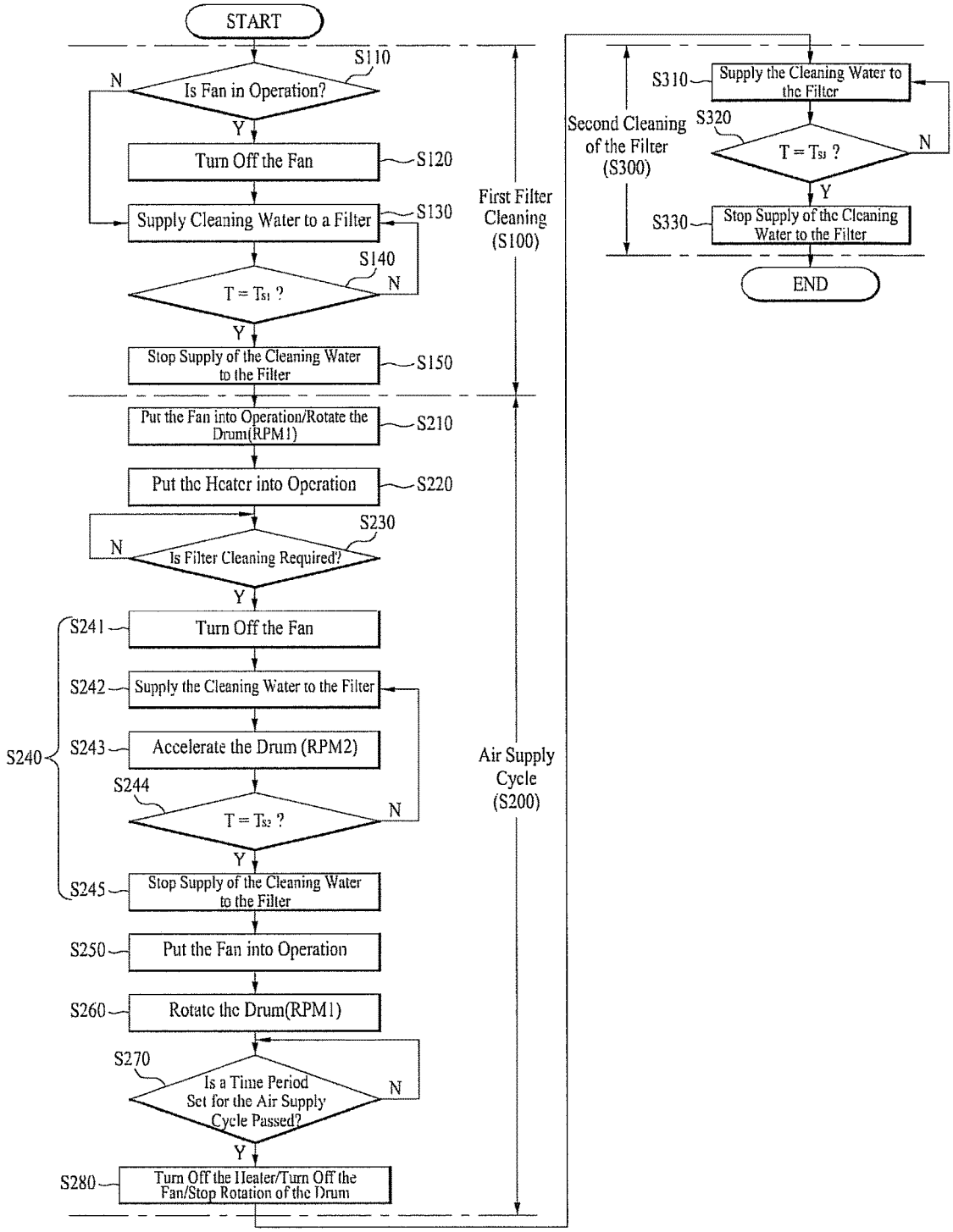
FIGS. 15 to 17 illustrate steps of a method for controlling a laundry machine in accordance with embodiments as broadly described herein.

In the embodiment shown in FIG. 15, the first filter cleaning step S100 is performed before starting the air supply cycle S200. However, in alternative embodiments, the first filter cleaning step S100 may be started after starting the air supply cycle S200. In this case, the step S110 for determining whether or not the fan is in operation is performed after the step S210 initiating operation of the fan in the air supply cycle S200, and, if first filter cleaning step S100 is finished, the step S230 for determining whether or cleaning of the filter 170 is required may then proceed.

Since the second filter cleaning step S300 may be performed after the air supply cycle S200 is finished, the second filter cleaning step S300 may include a step S310 for supplying cleaning water to the filter, a step S320 for determining whether or not the time period T in which the cleaning water is supplied to the filter has reached the preset time period Ts3, and a step S330 for stopping the supply of cleaning water to the filter.

The filter cleaning time period Ts1 in the first filter cleaning step, the filter cleaning time period Ts2 in the air supply cycle, and the filter cleaning time period Ts3 in the second filter cleaning step may be the same, or different from one another. However, since an amount of foreign matter deposited on the filter is likely to be the largest during the air supply cycle, Ts2 may be set to be larger than Ts1 or Ts3.

Figure 16:
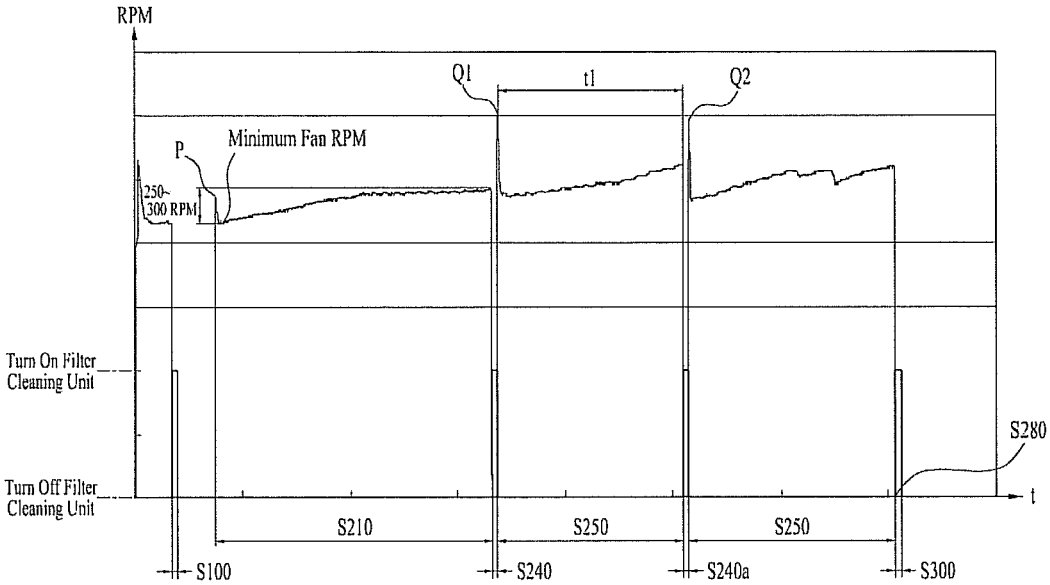

FIG. 16 is a flowchart of a method for controlling a laundry machine in accordance with embodiment as broadly described herein. This embodiment is different from the embodiment shown in FIG. 15 in that a step S240 for cleaning the filter is performed based on a determination in step S230 as to whether or not filter cleaning is required during the air supply cycle S200, and an additional cleaning step 240*a* may be performed for additional cleaning of the filter after a preset time period t1 has elapsed after completing the filter cleaning step S240.

That is, in the method shown in FIG. 16, whether or not a preset time period for the air supply cycle has elapsed is determined S270 after finishing the filter cleaning step S240. If the preset time period for the air supply cycle has not elapsed, the additional cleaning step 240*a* may be performed after a preset time period T1 has elapsed after finishing the filter cleaning step S240. Since detailed steps of the additional cleaning step 240*a* are substantially the same as the filter cleaning step S240 described above, further detailed description thereof will be omitted.

Figure 17:
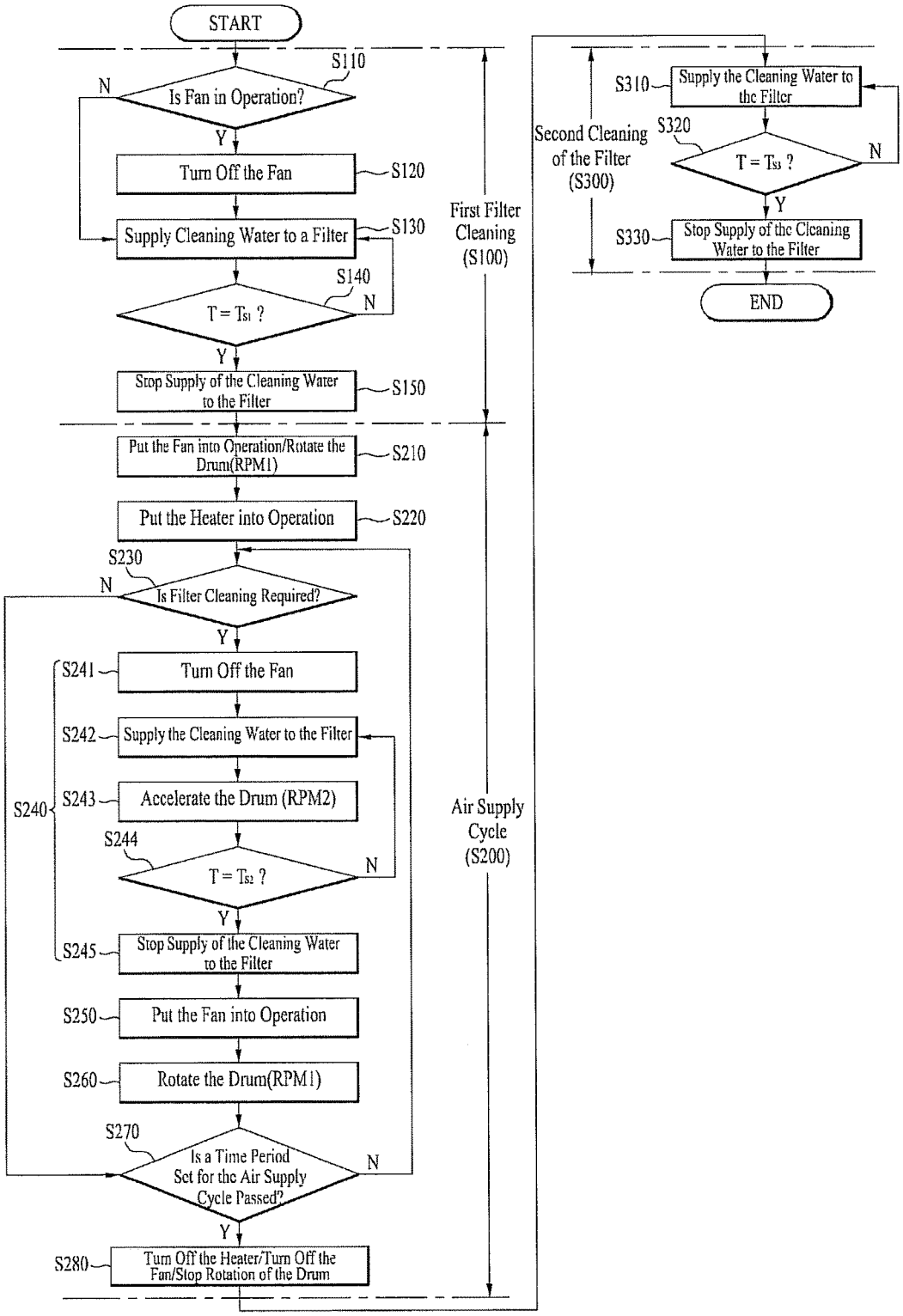

FIG. 17 is a flowchart of a method for controlling a laundry machine in accordance with another embodiment as broadly described herein. This embodiment is different from the embodiments shown in FIGS. 15 and/or 16, in that the air supply cycle S200 may end without necessarily performing the filter cleaning step S240, and in certain circumstances the filter cleaning step S240 may be repeated numerous times.

A laundry machine and method of controlling the same, as embodied and broadly described herein, may provide for an increase in a capacity of a tub in a cabinet having a given interior volume, and may include a supporting structure for providing effective support of such an increased capacity tub.

In a laundry machine and method of controlling the same, as embodied and broadly described herein, air from a tub may be condensed without a separate condensing duct.

In a laundry machine and method of controlling the same, as embodied and broadly described herein, a filter for filtering foreign matter from air from a tub may be provided.

In a laundry machine and method of controlling the same, as embodied and broadly described herein, means for removing foreign matter from a filter may be provided.

In a laundry machine and method of controlling the same, as embodied and broadly described herein, degradation in performance of the laundry machine during a course of removal of foreign matter deposited on a filter may be avoided.

A laundry machine and method of controlling the same are provided which may increase a capacity of a tub in a cabinet, and which may have a supporting structure that effectively supports such an increased capacity tub.

A laundry machine and method of controlling the same are provided which may condense air from a tub without a separate condensing duct.

A laundry machine and a method of controlling the same are provided, having a filter for filtering foreign matter from air from a tub.

A laundry machine and a method of controlling the same are provided, having means for removing foreign matter from a filter.

A laundry machine and a method of controlling the same are provided which may prevent degradation of performance of the laundry machine due to a course of removal of foreign matter deposited on a filter.

A method of controlling a laundry machine as embodied and broadly described herein may include an air supply cycle for supplying heated air or unheated air to clothes held in a holding space, wherein the air supply cycle includes the steps of putting a fan into operation for circulating the air in the holding space, the fan is provided in a duct which forms a flow passage for circulating the air in the holding space through the duct, and spraying cleaning water to a filter for removing foreign matter from the filter after stopping operation of the fan temporarily, the filter is positioned under the fan for removing the foreign matter from the air being introduced to the duct from the holding space.

The step for spraying cleaning water to a filter for removing foreign matter from the filter may be progressed when an amount of the foreign matter deposited on the filter reaches to a preset amount.

The step for spraying cleaning water to a filter for removing foreign matter from the filter may be progressed when RPM of the fan is increased to a preset RPM from a lowest RPM of the fan measured during the step for putting the fan into operation is in progress.

The step for spraying cleaning water to a filter for removing foreign matter from the filter may be progressed when RPM of the fan is increased to 250 to 300 RPM from a lowest RPM of the fan measured during the step for putting the fan into operation is in progress.

The method may further include a first filter cleaning step for supplying the cleaning water to the filter before starting the air supply cycle.

The method may further include a second filter cleaning step for supplying the cleaning water to the filter after finishing the air supply cycle.

The air supply cycle may further include a step for rotating a drum provided in the holding space for holding the clothes, the step for spraying cleaning water to a filter for removing foreign matter from the filter may include the step of spraying the cleaning water to the filter provided at a position spaced a predetermined distance from the rotation center of the drum, and the drum rotation step may be provided such that the drum is rotated in a direction the cleaning water introduced to the housing space through the filter is dropping.

The step for rotating a drum may include an accelerating step for increasing a rotation speed of the drum during the step for spraying cleaning water to a filter for removing foreign matter from the filter is in progress.

A method for controlling a laundry machine in accordance with another embodiment as broadly described herein, the laundry machine including a tub for holding washing water, a drum in the tub for holding clothes, a duct for forming a flow passage through which the air in the tub circulates, a fan provided in the duct for circulating the air from the inside of the tub through the duct, a communication hole passed through a circumferential surface of the tub at a position spaced a predetermined distance from a rotation center of the drum having a duct connected thereto, a filter provided to the communication hole for removing foreign matter from the air moving to the duct, and a filter cleaning unit for supplying cleaning water to the filter for removing the foreign matter from the filter, may include putting the fan into operation for circulating air inside of the tub, turning off the fan, supplying the cleaning water to the filter through the filter cleaning unit for removing foreign matter from the filter, and putting the fan into operation again for circulating air inside of the tub, again.

The method may further include a drum rotation step for rotating a drum, wherein the drum rotation step includes the step for rotating the drum in a direction the cleaning water being introduced to the tub through the filter is dropping.

The drum rotation step may include an accelerating step for increasing a rotation speed of the drum during the step for supplying the cleaning water to the filter through the filter cleaning unit for removing foreign matter from the filter is in progress.

The step for supplying the cleaning water to the filter through the filter cleaning unit for removing foreign matter from the filter may be progressed when an RPM of the fan is increased by a preset RPM from a lowest RPM measured during the step for putting the fan into operation is in progress.

In another embodiment as broadly described herein, a laundry machine may include a tub for holding washing water, a drum rotatably provided in the tub for holding laundry, an air supply unit including a heater for producing heated air, a fan for circulating the heated air produced thus, an air delivery pipe for introducing the heated air into the drum, and an air collection pipe for discharging the air which performs drying in the drum, a filter provided in the air collection pipe for filtrating lint from the air passing through the air collection pipe from the drum, a filter cleaning unit for spraying the cleaning water to the filter to remove the lint from the filter, and a cleaning water line branched from a water supply flow passage provided to the tub for supplying the cleaning water to the filter cleaning unit.

The filter cleaning unit may be provided over the filter for removing the lint by spraying the cleansing water to the inside of the tub.

The filter cleaning unit may include a body having a hollow for flowing of the cleaning water, and a cleaning water spray portion fastened to the body to have a hollow with one opened side and the other closed side for introducing the cleaning water therethrough.

The filter cleaning unit may further include a fastening portion having one end connected to the cleaning water line and the other end formed extended to the body of the cleaning water spray portion in communication with the one end for enabling the cleaning water to flow to the hollow.

The fastening unit may include a fastening rib formed extended from an outside circumferential surface for preventing the cleaning water from leaking to an outside of the air collection pipe.

The body may have a long bar shape for preventing interference with an air flow flowing through the air collection pipe.

The body may include a water leakage preventive step formed sloped in a direction of the fastening portion.

The washing water spray portion may include a plurality of first spray nozzles formed projected from an outermost portion thereof for spraying the cleaning water at a predetermined angle, and a plurality of second spray nozzles formed in a central portion and among the first spray nozzles for spraying the cleaning water in a vertical direction.

Each of the plurality of the first spray nozzles may have a spray hole in one side of a projected face to have a circumferential direction spray angle with reference to a center of the cleaning water spray portion as an axis.

The first spray nozzles and the second spray nozzles may be formed symmetrically with respect to a length direction of the cleaning water spray portion as an axis, respectively.

The body and the cleaning water spray portion may be coupled by fusion at fastening surfaces.

The heated air supply unit may include an air collection pipe on the tub at a side of a rear of the tub for discharging the air which performed drying in the drum, a fan provided to a top side of the air collection pipe for collecting and circulating the air, a duct for heating the air moving with the fan, and an air delivery pipe provided to an upper side of a front of the tub for introducing the heated air to the inside of the tub.

The tub may include a condensing water supply hole for enabling to form a condensing surface at an inside circumferential surface thereof for condensing condensed water.

The tub may be fixedly secured to the cabinet.

The laundry machine may further include a rotation shaft connected to the drum, a bearing housing which supports the rotation shaft rotatably, a driving motor for rotating the rotation shaft, and a suspension unit coupled to the bearing housing for attenuating the vibration of the drum.

The laundry machine may further include a rear gasket for sealing a rear of the tub for preventing water from leaking from the tub to the driving motor, and allowing the driving motor to make relative movement with respect to the tub.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a laundry machine, the laundry machine including a filter, a filter cleaning device, and a fan, the method comprising:

performing a first filter cleaning cycle of supplying cleaning fluid to the filter;

performing an air supply cycle for supplying heated air or unheated air to laundry items received in a receiving space of the laundry machine, the air supply cycle including:

operating the fan for circulating air in the receiving space, the fan being provided in a duct forming a flow passage for circulating air through the receiving space;

increasing a rotational speed of the fan from a lowest rotational speed to a preset rotational speed measured while operating the fan; and spraying cleaning fluid which comes from the filter cleaning device onto the filter to remove debris from the filter, the filter being positioned under the fan for removing debris from the air being introduced into the duct from the receiving space, wherein the filter cleaning device is provided above the filter and the fan is provided above the filter cleaning device, such that the cleaning fluid is sprayed onto the filter while the fan is turned off;

rotating a drum of the laundry machine that defines the receiving space in which the laundry items are received while spraying cleaning fluid onto the filter, wherein rotating a drum includes increasing a rotation speed of the drum while spraying cleaning fluid onto the filter, and performing a second filter cleaning cycle of supplying cleaning fluid to the filter after finishing the air supply cycle.

2. The method of claim 1, wherein operating the fan for circulating air in the receiving space is stopped temporarily while spraying cleaning fluid onto the filter.

3. The method of claim 1, wherein the spraying of cleaning fluid onto the filter is carried out when a rotational speed of the fan is increased to from a lowest rotational speed to 250 to 300 RPM measured while operating the fan.

4. A laundry machine, comprising:

a tub;

a drum rotatably provided in the tub for holding laundry;

an air supply device including a communication hole formed in a circumferential surface of the tub at a position spaced a predetermined distance from a rotation center of the drum, a duct for guiding air from the communication hole to an inside of the tub, an air collection pipe connected between the communication hole and the duct, a fan provided between the air collection pipe and the duct for circulating the air from the inside of the tub, and an air delivery pipe connected between the duct and the tub;

a filter positioned between the communication hole and the fan for removing foreign matter from the air being introduced into the duct; and a filter cleaning device positioned between the filter and the fan to supply cleaning water to the filter when the fan is not in operation for moving the foreign matter from the filter to the inside of the tub, wherein the air supply device further includes:

an air collection pipe connected between the communication hole and the duct, and an air delivery pipe connected between the duct and the tub, and the filter cleaning device including a body provided in the air collection pipe, and a cleaning water spraying portion having a curved face facing the filter for spraying cleaning water received from the body onto the filter, wherein the cleaning water spraying portion has a bar shape and has a plurality of first spray nozzles provided along an edge of the cleaning water spraying portion for spraying the cleaning water and a plurality of second spray nozzles provided among the plurality of first spray nozzles for spraying the cleaning water, the plurality of second spray nozzles having at least one of a different size, shape or orientation from the plurality of first spray nozzles.

5. The laundry machine of claim 4, wherein a radius of curvature of the filter is the same as that of the circumferential surface of the tub, and the filter cleaning device is provided between the filter and the fan.

6. The laundry machine of claim 4, wherein a spray area of the first spray nozzles is greater than or equal to an area of the filter.

* * * * *